US007107705B2

(12) United States Patent
Dalton et al.

(10) Patent No.: US 7,107,705 B2
(45) Date of Patent: Sep. 19, 2006

(54) INSOLE WITH IMPROVED CUSHIONING AND ANATOMICAL CENTERING DEVICE

(75) Inventors: Edward F. Dalton, Portland, OR (US); Jacob A. Martinez, Temple, TX (US); John C. Hardt, Belton, TX (US)

(73) Assignee: Spenco Medical Corporation, Waco, TX (US)

( * ) Notice: Subject to any disclaimer, the term of this patent is extended or adjusted under 35 U.S.C. 154(b) by 439 days.

(21) Appl. No.: 10/330,045

(22) Filed: Dec. 23, 2002

(65) Prior Publication Data

US 2004/0118017 A1 Jun. 24, 2004

(51) Int. Cl.
*A43B 13/40* (2006.01)

(52) U.S. Cl. ..... 36/44; 36/3 B; 36/28

(58) Field of Classification Search ..... 36/43, 36/3 B, 44, 28, 30 R
See application file for complete search history.

(56) References Cited

U.S. PATENT DOCUMENTS

| | | | | |
|---|---|---|---|---|
| 360,127 | A | 3/1887 | Wallis | |
| 892,360 | A | 6/1908 | Burns | |
| 2,224,642 | A | 12/1940 | Burns | |
| 2,985,971 | A | 5/1961 | Murawski | 36/29 |
| 3,922,801 | A | 12/1975 | Zente | 36/44 |
| 4,033,054 | A | 7/1977 | Fukuoka | 36/11.5 |
| 4,108,928 | A | 8/1978 | Swan, Jr. | 264/26 |
| 4,123,855 | A * | 11/1978 | Thedford | 36/44 |
| 4,150,455 | A | 4/1979 | Fukuoka | 12/142 RS |
| 4,219,945 | A | 9/1980 | Rudy et al. | 36/29 |
| 4,229,546 | A | 10/1980 | Swan, Jr. | 521/55 |
| 4,237,626 | A | 12/1980 | Brown | 36/43 |
| 4,346,205 | A | 8/1982 | Hiles | 528/53 |
| 4,435,910 | A | 3/1984 | Marc | 36/44 |
| 4,541,184 | A | 9/1985 | Leighton | 36/44 |
| 4,541,186 | A | 9/1985 | Mulvihill | 36/114 |
| 4,557,060 | A | 12/1985 | Kawashima | 36/44 |
| 4,581,187 | A | 4/1986 | Sullivan et al. | 264/46.4 |
| 4,597,196 | A | 7/1986 | Brown | 36/44 |
| 4,616,430 | A | 10/1986 | McQuiggin | 36/14 |
| 4,619,056 | A | 10/1986 | Lin et al. | 36/43 |
| 4,627,178 | A | 12/1986 | Sullivan et al. | 36/44 |
| 4,627,179 | A | 12/1986 | McElroy | 36/44 |
| 4,633,598 | A | 1/1987 | Moronaga et al. | 36/44 |
| 4,674,204 | A | 6/1987 | Sullivan et al. | 36/44 |
| 4,694,589 | A | 9/1987 | Sullivan et al. | 36/44 |
| 4,694,831 | A | 9/1987 | Seltzer | 128/582 |

(Continued)

FOREIGN PATENT DOCUMENTS

| | | |
|---|---|---|
| DE | 2603716 | 12/1976 |

(Continued)

*Primary Examiner*—Ted Kavanaugh
(74) *Attorney, Agent, or Firm*—Sidley Austin Brown & Wood LLP

(57) ABSTRACT

An insole having a molded base and a top sheet. The insole includes directional air ports for facilitating airflow above and below the insole. In addition, the insole has a shock absorbing pad positioned on the bottom of the base to provide cushioning to the area of the joints of the metatarsals and proximal phalanges and along a portion of the fifth metatarsal. A rear shock absorbing pad is provided which provides cushioning to the center of the calcaneus and which has an extension along the medial portion to provide cushioning to the talus. Two anatomical centering devices are provided on each side of the rear portion of the insole to support and direct the foot into the proper position over the cushioning pads. The medial anatomical centering device also provides additional stiffness to the arch area.

20 Claims, 4 Drawing Sheets

U.S. PATENT DOCUMENTS

| | | | | | |
|---|---|---|---|---|---|
| 4,744,157 | A | * | 5/1988 | Dubner | 36/88 |
| 4,756,949 | A | | 7/1988 | Spence et al. | 428/159 |
| 4,793,078 | A | | 12/1988 | Andrews | 36/43 |
| 4,808,469 | A | | 2/1989 | Hiles | 428/318.6 |
| 4,841,648 | A | * | 6/1989 | Shaffer et al. | 36/43 |
| 4,910,886 | A | | 3/1990 | Sullivan et al. | 36/44 |
| 4,977,691 | A | | 12/1990 | Orchard, III | 36/44 |
| 5,092,060 | A | | 3/1992 | Frachey et al. | 36/29 |
| 5,152,081 | A | | 10/1992 | Hallenbeck et al. | 36/28 |
| 5,155,927 | A | * | 10/1992 | Bates et al. | 36/28 |
| 5,174,049 | A | | 12/1992 | Flemming | 36/28 |
| 5,175,946 | A | | 1/1993 | Tsai | 36/29 |
| 5,233,768 | A | | 8/1993 | Humphreys | 36/44 |
| 5,233,769 | A | | 8/1993 | Weber | 36/44 |
| D341,023 | S | | 11/1993 | Frederick | D2/318 |
| 5,319,867 | A | | 6/1994 | Weber | 36/44 |
| 5,384,974 | A | | 1/1995 | Massimo | 36/27 |
| 5,404,659 | A | | 4/1995 | Burke et al. | 36/176 |
| 5,438,768 | A | | 8/1995 | Bauerfeind | 36/44 |
| 5,463,824 | A | | 11/1995 | Barna | 36/44 |
| 5,509,218 | A | | 4/1996 | Arcan et al. | 36/43 |
| 5,551,173 | A | * | 9/1996 | Chambers | 36/44 |
| 5,553,398 | A | | 9/1996 | Schnewlin-Maier | 36/43 |
| 5,619,809 | A | | 4/1997 | Sessa | 36/3 R |
| 5,664,342 | A | | 9/1997 | Buchsenschuss | 36/43 |
| 5,685,094 | A | | 11/1997 | Lin | 36/141 |
| 5,722,186 | A | | 3/1998 | Brown | 36/43 |
| 5,771,606 | A | | 6/1998 | Litchfield et al. | 36/29 |
| 6,082,023 | A | | 7/2000 | Dalton | 36/28 |
| 6,176,025 | B1 | | 1/2001 | Patterson et al. | 36/28 |
| 6,192,607 | B1 | | 2/2001 | Kolada et al. | 36/145 |
| 6,233,847 | B1 | | 5/2001 | Brown | 36/44 |
| 6,301,805 | B1 | | 10/2001 | Howlett et al. | 36/43 |
| 6,301,807 | B1 | | 10/2001 | Gardiner | 36/155 |
| 2002/0007569 | A1 | | 1/2002 | Crane et al. | |
| 2003/0093920 | A1 | | 5/2003 | Greene et al. | |

FOREIGN PATENT DOCUMENTS

| | | |
|---|---|---|
| DE | 3227505 | 1/1984 |
| DE | 3330060 | 2/1985 |
| DE | 200 11 334 U1 | 1/2001 |
| EP | 0411598 | 2/1991 |
| EP | 0619084 | 10/1994 |
| EP | 0820706 | 1/1998 |
| GB | 1515810 | 6/1978 |
| GB | 2 039 716 A | 8/1980 |
| GB | 2061172 | 5/1981 |
| GB | 2221378 | 2/1990 |
| SU | 1653724 | 6/1991 |
| WO | WO9528103 | 10/1995 |
| WO | WO 00/72714 A1 | 12/2000 |

* cited by examiner

INSOLE WITH IMPROVED CUSHIONING AND ANATOMICAL CENTERING DEVICE

FIELD OF THE INVENTION

The present invention relates to insoles and, in particular, replacement soles for footwear having improved cushioning and anatomical centering assistance.

BACKGROUND OF THE INVENTION

Much of the footwear sold today includes replaceable insoles. Replaceable insoles offer the user several benefits which include the ability to replace worn insoles, the ability to select an insole which is specifically designed for the requirements of the user, e.g., running, prolonged standing, fallen arches, etc. Many replaceable insoles are made utilizing a foam material which over time can lose its cushioning properties due to compaction from use and normal wear and tear. Thus, replaceable insoles allow a consumer to maintain the benefits of the insole by replacing worn out insoles.

Replaceable insoles can be made in individual sizes corresponding to shoe size or made in a limited number of sizes and the insole can be trimmed down to the desired size. Replaceable insoles have been designed to fulfill specific purposes such as shock absorption, and structures intended to facilitate the proper orthopedic placement of the foot, support for fallen arches, etc. Frequently, insole designs intended to assist in the proper alignment of the foot, or to address other orthopedic concerns, have involved more complex construction than insoles designed only to provide cushioning. The more complex construction frequently uses additional features such as stiff components to assist and maintain the proper orientation of the foot.

One advantage of making replaceable insoles in individual sizes, corresponding to shoe sizes, is that the more complex designs to produce particular orthopedic results can be utilized more effectively. In the past, it has been difficult to make a multi-sized insole which included rather rigid support elements to achieve certain orthopedic results. The disadvantage of producing replaceable insoles in individual sizes include requiring a mold for each size, requiring inventory and marketing support for all sizes of shoes, increased requirement for retail display space, and other production and marketing disadvantages. In addition, insole designs having relatively stiff components even when made to each shoe design, many times do not properly fit all shoes of a particular size because of differences in shoe designs used by the various manufacturers. The benefit of multi-sized replaceable insoles include reduced numbers of molds, reduced inventory requirements and retail display space. The disadvantage of previous multi-sized replaceable insoles has been that it was difficult to effectively incorporate features designed to achieve orthopedic benefits.

Thus, there has been a need for a multi-sized replaceable insole design which can utilize relatively stiff support members and yet properly fit in a variety of different sized shoes. Also, there has been a need for a replaceable insole design that includes relatively stiff support members that can better fit a particular shoe size to account for differences in shoe designs from the various manufacturers.

BRIEF SUMMARY OF THE INVENTION

In one aspect, the present invention relates to an insole made from a base which defines the shape of an insole and has a top and bottom side. The insole has a lateral side (outside of the foot) and a medial side (inside of the foot). A medial anatomical centering member is positioned along the medial side of the base and extends from about the front of the arch to the heel. A lateral anatomical centering member is positioned along the lateral side of the base and extends along the side portion of the insole adjacent to the talus and the calcaneus. These anatomical centering devices are made of a relatively stiff but flexible material. In a preferred embodiment, the insole also includes one or more shock absorbing pads on the bottom surface. Preferably, there are two shock absorbing pads. The first shock absorbing pad is shaped to provide cushioning in the area of the center of the calcaneus and which extends along the lateral side portion of the talus. Another pad is shaped so that it provides cushioning under the joints of the metatarsals and the proxima phalanges and has a portion which extends along the fifth metatarsal. Preferably, the shock absorbing cushioning pads have a plurality of passageways to facilitate air flow in and out of the shock pad. Also, in a preferred embodiment the base defines a plurality of directional air ports which extend through the base and the top sheet attached to the base. The air ports are shaped so as to facilitate a directional pumping action by the action of the foot during rocking to circulate air above and below the insole. In a further preferred embodiment, the top sheet is a low coefficient of friction fabric having a vapor barrier film attached to the side adhered to the base.

BRIEF DESCRIPTION OF THE DRAWINGS

The present invention will be better understood with reference to the accompanying drawing in conjunction with the detailed description. The drawings in the detailed description are of preferred embodiments of the invention and, thus, are not to be considered limiting.

DETAILED DESCRIPTION OF THE INVENTION

Figure 1:
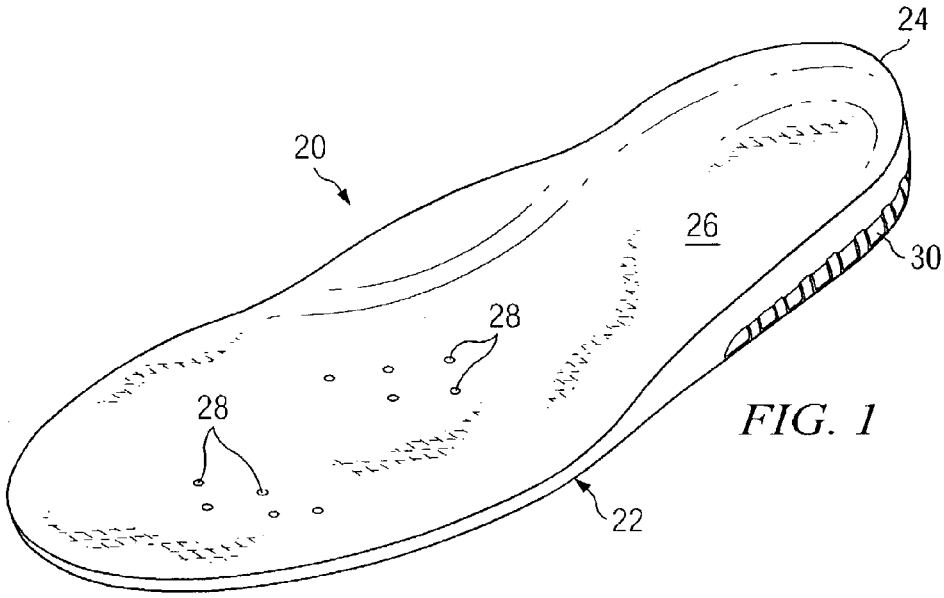
FIG. 1 is a perspective view of one embodiment of the present invention.

FIG. 1 is a perspective view of insole 20 of the present invention. Insole 20 is made from a base 22 of molded foam material. Preferably, base 22 defines the shape of an insole for a full or partial insole such as, for example, an insole which is three-quarters length from the heel to the front portion of the foot. Base 22 is preferably molded to provide a raised edge 24 along the arch and around the heel. In a preferred embodiment, the base 22 is covered with top sheet 26. Additionally, in a preferred embodiment, a series of air ports 28 extend through the base 22 and the top sheet 26 to permit air circulation above and below the insole. Running along the rear edge portion of insole 20 is a lateral anatomical centering device 30 (medial anatomical centering device not shown in FIG. 1). In the various figures like numbers will be utilized to refer to like elements.

Figure 2:
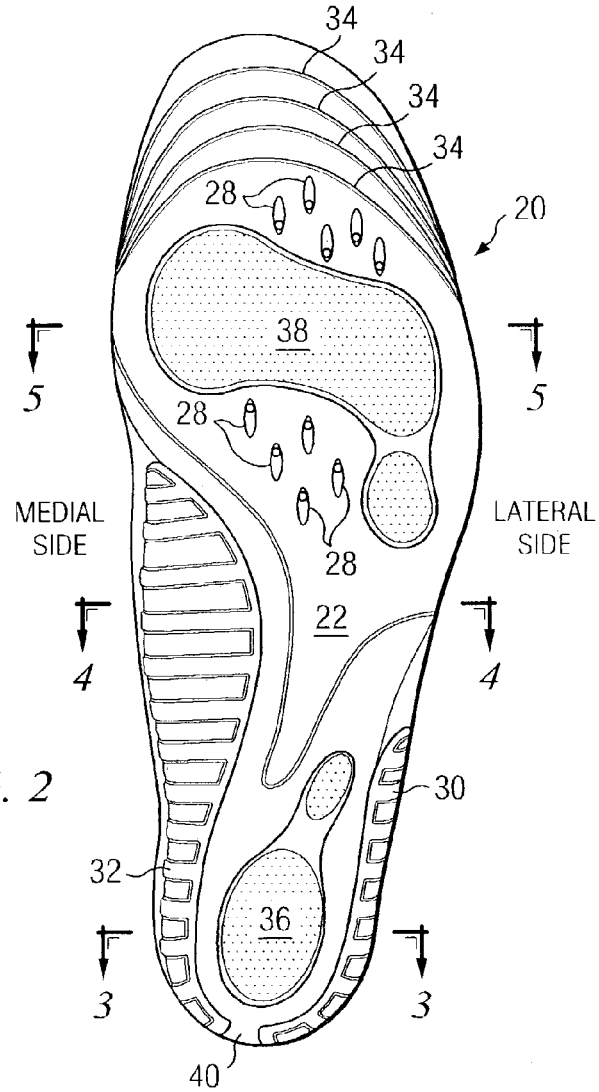
FIG. 2 is a bottom view of one embodiment of the present invention.

FIG. 2 is a bottom view of a preferred embodiment of insole 20 of the present invention. As can be seen in the figure, there is a medial anatomical centering device 32 which is of a relatively stiff material to provide support to the arch and outside of the medial side of the foot. Opposite the medial anatomical centering device 32 is the lateral anatomical centering device 30. Both anatomical centering devices cover a portion of the bottom surface of base 22. In a preferred embodiment, grooves 34 are provided in the front portion of base 22. The grooves correspond to various lengths for different shoe sizes and facilitate trimming the insole to fit in a user's shoe. Positioned on the bottom of base 22 is a rear shock absorbing pad 36 and a forward shock absorbing pad 38. The medial and lateral anatomical centering devices 30 and 32 do not join at the rear and are separated by a portion of the foam base. This separation provides a compression area 40 such that when the insole is placed in a shoe, this area can compress to minimize possible buckling in the heel area when the insole is placed in smaller shoes. This facilitates proper fit of the insole in shoes of various sizes. Without this relief area, if the first and second anatomical correction devices were joined together as a single piece, the fit of the insole in different size shoes could be compromised.

Figure 3:
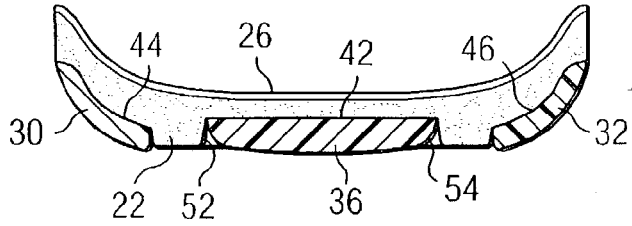
FIG. 3 is a cross sectional inverted view of FIG. 2 along line 3—3.

FIG. 3 is an inverted cross section of the insole in FIG. 2 along line 3—3. Base 22 defines a location first for the heel shock absorbing pad 36. The first location, in the form of recess 42 is for receiving rear shock absorbing pad 36. Base 22 also defines channels 44 and 46 for receiving the medial and the lateral anatomical centering devices 32 and 30. It should be noted that in FIGS. 3, 4, and 5 the cross sectional representations have been inverted so that the figures appear such that the top of the insole is at the top of the picture. On the top of base 22 is top sheet 26 (drawing not to scale to show top sheet).

Figure 4:
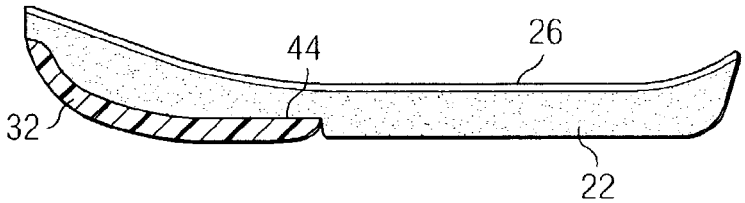
FIG. 4 is a cross sectional inverted view of FIG. 2 along line 4—4.

In FIG. 4 is an inverted cross section along line 4—4 of FIG. 2. In FIG. 4, is the base 22 with top sheet 26 and a continuation of channel 44. Channel 44 is larger in the arch area so that the medial anatomical centering device 32 is positioned below the arch area of the foot and extends up a portion of the side of the arch of the insole.

Figure 5:
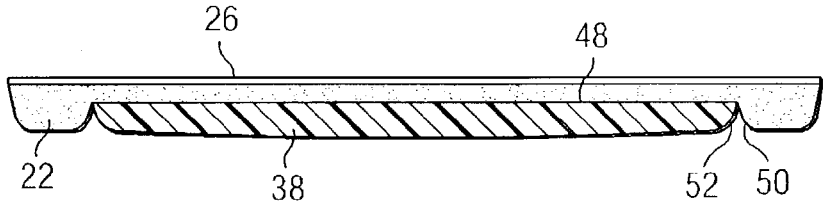
FIG. 5 is a cross sectional inverted view of FIG. 2 along line 5—5.

FIG. 5 is an inverted cross sectional view along line 5—5 of FIG. 2. Again, as shown, top sheet 26 is on the top surface of base 22. Base 22 defines a recess 48 in which forward shock pad 38 is positioned. In a preferred embodiment, the edge 50 of recess 48 is chamfered. Also, in a preferred embodiment, the edge of shock pad 38 is chamfered. Likewise, in FIG. 3 the edges 52 of recess 42 and edge 54 of rear shock pad 36 are chamfered. Additionally, in a prefered embodiment the top edge of the shock pads 36 and 38 do not contact the upper edge of recesses 42 and 48 to provide a slight space between the base and the shock absorbing pads. Providing a slight space between the edges, in addition to the chamfering of the edges, provides a space into which the shock absorbing pads may be compressed.

Figure 6:
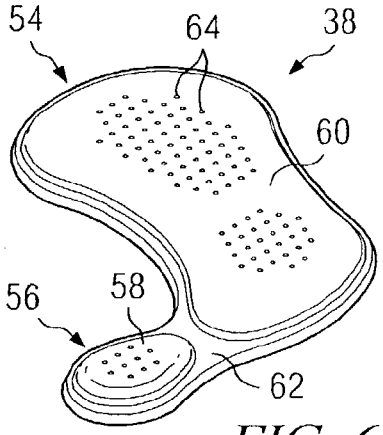
FIG. 6 is a perspective view of one embodiment of a forward shock absorbing pad.

FIG. 6 is a prospective view illustrating forward shock absorbing pad 38. This would be a shock absorbing pad for the left foot. The forward shock absorbing pad 38 has a first oblong area 54 which is shaped and dimensioned so as to provide cushioning in the area of the joints between the first metatarsals and the proximal phalanges. In a preferred embodiment, extending from one end of oblong area 54 is extension 56 which is dimensioned to provide cushioning along an extended portion of the fifth metatarsal. In a preferred embodiment, extension 56 includes a raised portion 58 and the oblong area 54 includes a raised portion 60. These raised areas are separated by a thinner portion 62, which provides an area for compression, and also a channel to promote air circulation. In a preferred embodiment, the shock pad includes a plurality of passageways 64. These passageways promote airflow in and out of the shock absorbing pads to improve the shock absorbing functioning.

Figure 7:
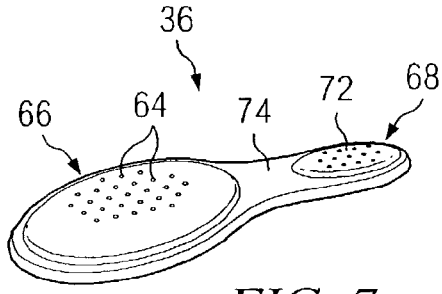
FIG. 7 is a perspective view of one embodiment of a rear shock absorbing pad.

FIG. 7 shows rear shock absorbing pad 36. Rear shock absorbing pad 36 has a heel area 66 shaped to provide support under the center of the calcaneus. In a preferred embodiment, the shape is an elongated oval. However, a circular shape, square or other shapes are also useful. Extending from the heel area is extension 68 which extends along a portion of the lateral side of the talus. Preferably, it extends more than about 30% of the side portion of the talus. Rear shock pad 36 in the preferred embodiment has a raised area 66 under the heel and a second raised area 72 under the talus. These raised areas are separated by a thinner portion 74. This area allows compression of the two raised areas and also provides a space to promote air circulation. Rear shock absorbing pad 36 also has a plurality of passageways 64 to promote air circulation into and out of the shock absorbing pad.

Figure 8:
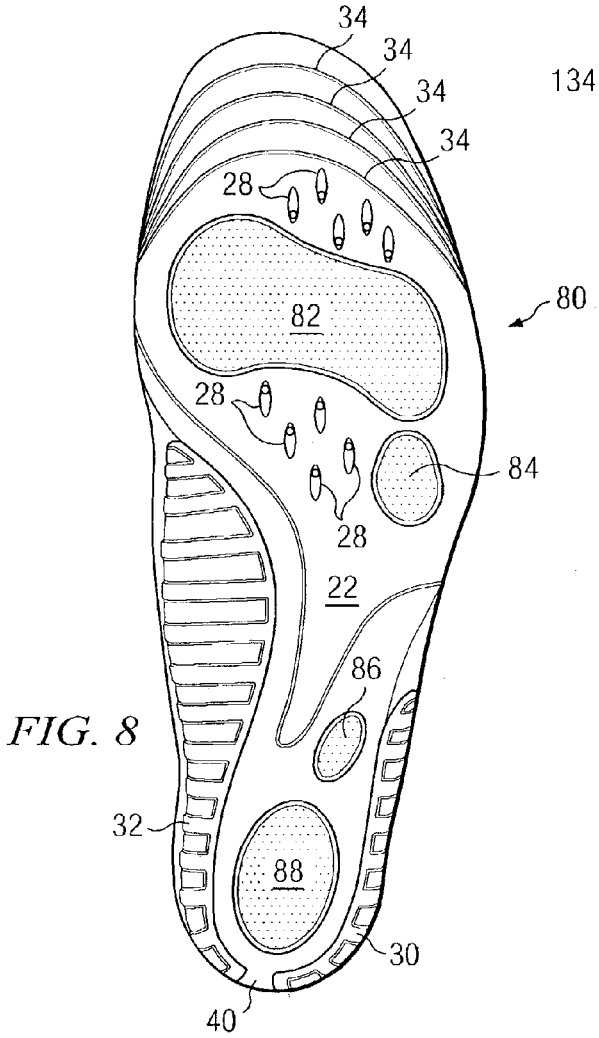
FIG. 8 is a bottom view of another embodiment of the present invention.

FIG. 8 is an alternate embodiment of the present invention. In FIG. 8, insole 80 has a base 22, a first anatomical centering device 32 and a second anatomical centering device 30. The device of the preferred embodiment also includes a plurality of air ports 28. This embodiment differs from the embodiment of FIG. 2 in that the base defines four separate recesses for receiving four shock pads 82, 84, 86, and 88. Shock pad 82 is shaped so as to provide cushioning in the area of the joints between the metatarsals and the first phalange. Shock pad 84 is shaped to provide cushioning along an area which includes at least a portion of the fifth metatarsals. Shock pad 86 is shaped to provide cushioning along a lateral side portion of the talus. Heel shock pad 88 is shaped to provide cushioning under the center portion of the calcaneus.

Figure 9:
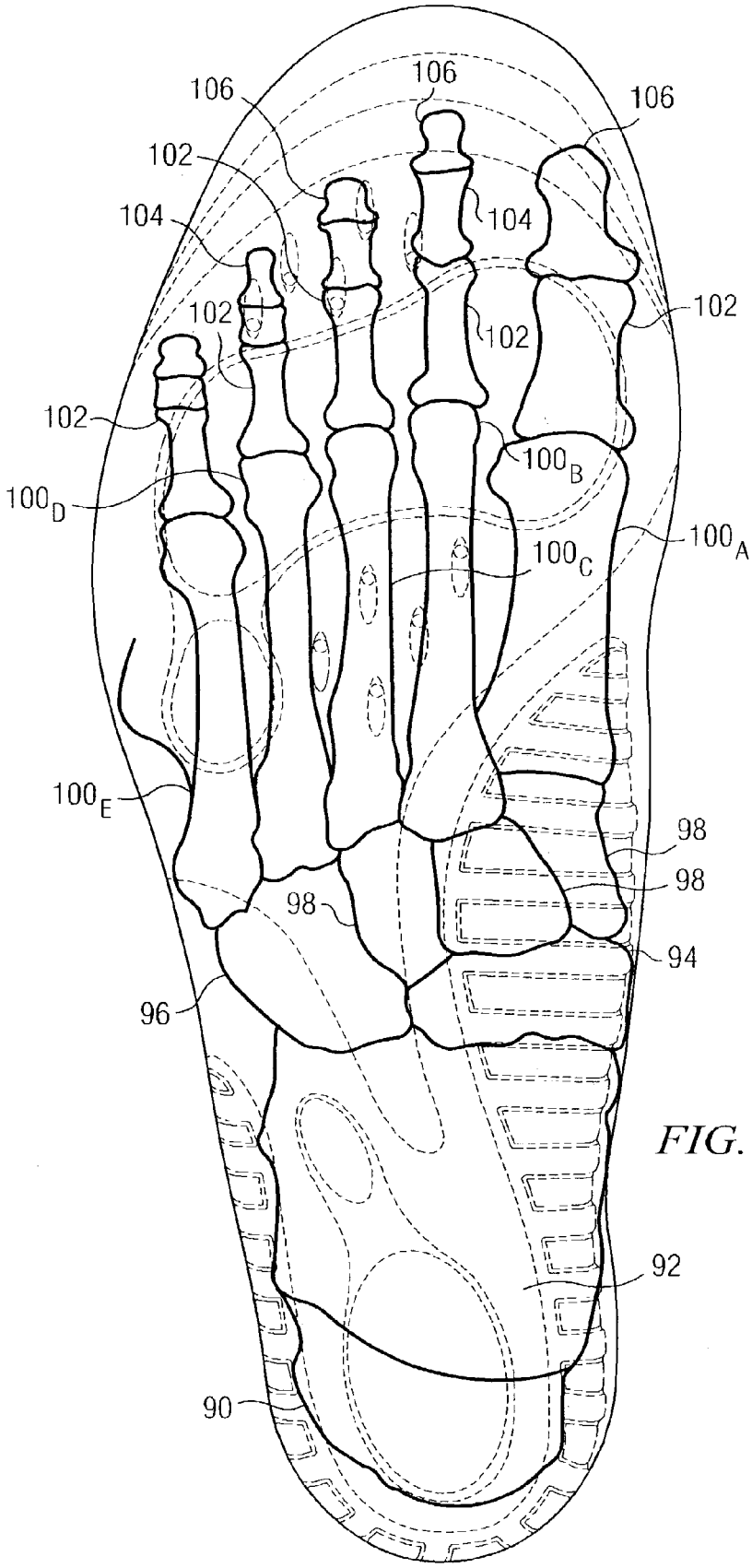
FIG. 9 is a bottom view of an embodiment of present invention with the bones of the foot superimposed on it.

FIG. 9 illustrates the bones of the foot superimposed over a bottom view of the insole of the present invention. At the heel of the foot is the calcaneus 90 and forward of the calcaneus is the talus 92. Forward of the talus 92 on the medial side is the navicular 94 and on the lateral side is the cuboid 96. Forward of the cuboid and the navicular are cuneiforms 98. Forward of the cuneiforms 98 and cuboid 96 are the metatarsals 100A–100E. The first metatarsal 100A is located on the medial side of the foot and the fifth metatarsal 100E is located on the lateral side of the foot. Forward of the metatarsals are the proximal phalanges 102. Forward of the proximal phalanges 102 are the middle phalanges 104, and at the end of each toe are the distal phalanges 106.

Figure 10:
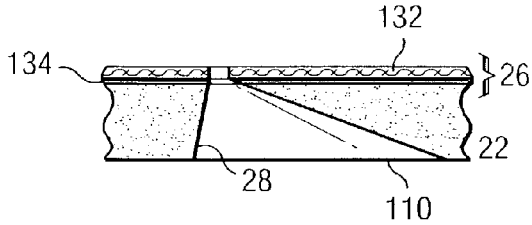
FIG. 10 is a cross sectional view of an air port used in the present invention.

FIG. 10 is a cross sectional view of an air port 28. The air port has a conical shape which creates an elliptical opening 110 at the bottom of the base 22, and the air port extends through the fabric layer 132 and film 134 of top sheet 26. In a preferred embodiment, a plurality of air ports are located in front of the forward shock pad facing towards the front so as to direct air to the front of the insole. In a preferred embodiment, there are a plurality of air ports located between the rear of the forward shock pad, and in front of the mid point of the arch. These air ports are preferably shaped so as to direct air to the back of the insole.

Figure 11B:
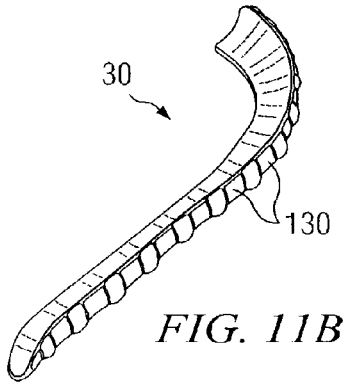
FIG. 11B is a perspective view of the lateral anatomical centering device.
Figure 11A:
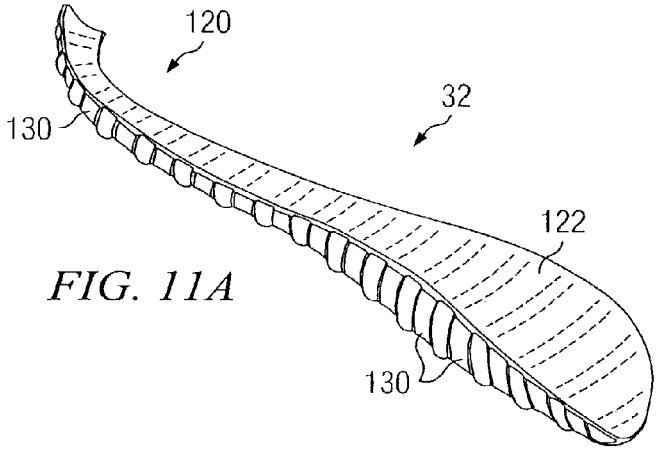
FIG. 11A is a perspective view of the medial anatomical centering device.

FIG. 11A is a perspective view of the medial anatomical centering device 32. The device 32 is a curved surface. The rear portion 120 is generally in the shape of a "J" and the bottom section becomes wider as the arch is approached. In the preferred embodiment the lower portion under the arch section 122 is shaped like the outline of the bottom of the foot's arch. FIG. 1B is a perspective view of the lateral medial anatomical centering device 30. In a preferred embodiment, each anatomical centering device has a plurality of channels 130 on the outer surface. These channels provide for both fit and air circulation. The channels provide areas for compression of the exterior wall of the shoe into a portion of the channel. Also, the channels provide passageways for air to circulate above and below the insole.

In a preferred embodiment, the top sheet 26 is a non-woven fabric layer 132 with a film laminated 134 to the back side. This film serves as a barrier so that liquid foam used in molding the base does not penetrate the fabric during the molding operation. This same film will also act as a moisture barrier between the fabric and the foam in use. In a preferred embodiment, the fabric is treated with an antibacterial agent, which in combination with the moisture barrier reduces odor causing bacteria and fungus. Also, preferably the fabric has a low coefficient of friction so as to minimize the possibility of blisters. Suitable materials for the fabric layer include polyester and nylon. Suitable materials for the film include polyurethanes and acrylics.

The base of the insole is preferably molded using a foam which has cushioning properties substantially the same as the fatty pads of the foot. Preferably, the foam is a polyurethane foam which has a durometer (hardness) of preferably from about 75 to about 80 on the "00" Shore gauge. The base preferably has a thickness of about 0.170 inches in the toe area and a thickness of about 0.380 inches in the heel area. The base preferably provides a cushioning value from about 14 to about 17 (peak-G) on an Exeter Impact Tester. Also, in the preferred embodiment is illustrated the foam molded on the top surface in a shape such that the insole shapes the natural shape of the foot.

The forward shock pad and the rear shock pad may be molded in place or separately. Preferably, for ease of construction, the shock absorbing pads are molded separately and glued into the recesses on the molded base. The shock pads are preferably made from a polyurethane foam. The shock pads of the thickest part are approximately 0.220 inches thick, the forefoot of the base is about 0.120 inches in thickness and the reduced thickness areas of the pad are about 0.060 inches in thickness. Each of the shock pads incorporate a plurality of 120–500 perforations. These passageways serve to increase the airflow in and out of the pad. Each passageway in a preferred embodiment is about 0.030 inches to 0.020 inches in diameter, and they are spaced from 0.090 to 0.100 inches apart. Also, airflow within the pad and around the insole is aided by the directional air circulation ports that are molded into the base of the insole and are positioned in front and in rear of the forward shock pad. These circulation air ports have a truncated cone shape as shown in FIG. 10, which illustrates a cross section of the air ports. The air ports in front of the shock pad preferably have an opening which communicates with the top of the insole and passes through the top sheet (if the top sheet is utilized). The conical shape results in a passageway which extends as a channel towards the front from the top of these openings. The air circulation ports behind the foreward shock pads have openings on the top sheet and channels formed on the bottom of the base which extend rearwardly from the holes. The bottom opening of the air port is elliptical in shape. The top opening is from about 0.060 to about 0.080 inches in diameter, and the elliptical opening at the bottom has a long axis from about 0.4 to about 0.5 inches long and a short axis of about 0.14 to about 0.15 inches long.

The foreward shock pad in the preferred embodiment includes an extension on the lateral side which extends rearward to provide cushioning in the impact zones of the cuboid and fifth metatarsal. In a preferred embodiment the forward shock pad has a durometer (hardness) from about 70 to about 75 on the "00" Shore gauge, and a thickness of about 0.140 inches at the thickest portion and about 0.045 inches at the thinnest portion.

In addition to the air ports, the chamfered perimeter of the recesses and of the shock absorbing pads allow for increased airflow in and out of the pad by providing a channel for airflow. With each step the foot forces air through the top surface air ports and at the bottom of the insole via the elliptical exhaust ports. The elliptical shape of the air ports direct the air on the bottom side of the base both forward and rearward which in addition to facilitating airflow in and out of the shock pads, also helps to cool the foot and dissipate moisture.

The rear shock pad is a preferred embodiment made of a similar or same material as the forward shock pad. This pad can also be molded separately and then glued into the recess of the molded base. The rear shock pad is typically thicker than the forward shock pad so as to help cushion the extreme force of heel strikes. In a preferred embodiment the rear shock pad has a durometer (hardness) from about 65 to about 70 on the "00" Shore gauge and a thickness of about 0.220 inches at the thickest portion and about 0.110 inches at the thinnest portion. Like the forward shock pad, the rear shock pad includes an expansion type joint at the edge and chamfered sides to allow expansion of the material during impact. This feature aids the different materials used for the pads and base which preferably have different densities to expand and is very useful in the absorption and dispersion of impact energy. The rear shock pad, in addition to providing cushioning to the calcaneus, also has an additional area which targets the loading of the talus.

The two anatomical centering devices are provided on each side of the rear of the insole. The lateral anatomical centering device begins at a point between the cuboid and the talus joint and proceeds around a portion of the heel, and preferably extends around to approximately the mid-point of the rear of the heel. The medial anatomical correction device begins in the heel and extends preferably from the rear portion of the heel past the arch and ends along the side of the first metatarsal. A space is provided between the medial and lateral anatomical correction devices to facilitate fitting the insole into different size and designed shoes.

Preferably, the anatomical centering devices are made from a stiff material which has some rigidity. In a preferred embodiment the anatomical center devices have a durometer (hardness) from about 90 to about 100 on the "00" Shore gauge, and a thickness at the thickest portion of about 0.100 inches and about 0.070 inches at the thinnest portion. Thus, channels 130 preferrably have a depth of about 0.030 inches. While the material is stiff, it is still flexible. Preferably, on the outside of the anatomical centering device are ribs. The space 40 between the anatomical centering devices is preferably from about 0.2 to 0.5 inches. These allow areas where parts of the shoe can be pressed into the spaces to provide and allow fit in different shoes. The anatomical correction devices are preferably injected molded in the shape of a J or reverse J, depending on the side of the insole. The shape and stiffness of the anatomical correction device transfers up and into the base of the insole creating a heel cupped in a raised arch area. The heel cup feature of the anatomical correction device helps stablize the foot and keep it centered and contained over the rearward or the heel shock absorbing pad. Also, it provides support for the arch area and is designed to lift and support the brebis muscles, ligaments and tendons of the foot.

The preferred materials for the various components are:

| Part | Material |
|---|---|
| base | polyurethane foam |
| shock absorbing pads | polyurethane foam |
| anatomical centering device | TPU (thermal polyurethane) |
| top fabric sheet | polyester |
| barrier film | polyurethane |

While the present invention has been described in relation to preferred embodiments, the detailed description is not limiting of the invention and other modifications will be obvious to one skilled in the art.

What is claimed is:

1. An insole comprising:

a base of foam material defining the shape of an insole and having a top side and a bottom side;

a first anatomical centering member positioned along the medial side of said base from about the front of the arch to the heel;

a first shock absorbing pad defining a shape to provide cushioning of the area of the joints of metatarsals and proximal phalanges and to an extended portion of the fifth metatarsal and positioned on said bottom side of said base; and a second anatomical centering member positioned along the lateral side of said base extending along the side of the talus and the calcaneus.

2. An insole of claim 1 further comprising:

a second shock absorbing pad defining a shape to provide cushioning in the area of the center of the calcaneus and extending along the lateral side portion of the talus and positioned on said bottom side of said base.

3. An insole of claim 2 wherein said second shock absorbing pad defines a plurality of passageways to facilitate air flow in and out of said second shock absorbing pad.

4. An insole of claim 1 wherein said first shock absorbing pad defines a plurality of passageways to facilitate air flow in and out of said first shock absorbing pad.

5. An insole of claim 1 wherein the first and second anatomical centering members are spaced apart at the heel.

6. An insole of claim 5 wherein a portion of the foam material is disposed between the first and second anatomical centering members.

7. An insole of claim 1 wherein the base defines a plurality of directional air ports.

8. An insole of claim 7 wherein the directional air ports are substantially conical in cross section.

9. An insole of claim 7 wherein air ports disposed forward of the first shock absorbing pad direct air toward the front of the insole and air ports rearward of the first shock absorbing pad direct air toward the rear of the insole.

10. An insole comprising:

a base of foam material defining the shape of an insole and having a top side and a bottom side and further defining a first location for receiving a first shock absorbing pad, and a second location for receiving a second shock absorbing pad and further defining a plurality of directional air ports through said base;

a first anatomical centering member positioned along the medial side of said base from about the front of the arch to the rear of the lateral side of the heel;

a first shock absorbing pad defining a shape to provide cushioning in the area of the joints of metatarsals and proximal phalanges and to an extended portion of the fifth metatarsal and positioned on said bottom side of said base;

a second shock absorbing pad defining a shape to provide cushioning in the area of the center of the calcaneus and extending along the lateral side portion of the talus and positioned on said bottom side of said base; and a second anatomical centering member positioned along the lateral side of said base extending along the side of the talus and the calcaneus.

11. An insole of claim 10 wherein second shock absorbing pad is dimensioned such that said second shock absorbing pad is smaller than said second location to provide an expansion joint between them.

12. An insole of claim 10 wherein said first shock absorbing pad defines a plurality of passageways to facilitate air flow in and out of said first shock absorbing pad.

13. An insole of claim 12 wherein said second shock absorbing pad defines a plurality of passageways to facilitate air flow in and out of said second shock absorbing pad.

14. An insole of claim 10 wherein said second shock absorbing pad defines a plurality of passageways to facilitate air flow in and out of said second shock absorbing pad.

15. An insole of claim 10 wherein first shock absorbing pad is dimensioned such that said first shock absorbing pad is smaller than said first location to provide an expansion joint between them.

16. An insole of claim 15 wherein second shock absorbing pad is dimensioned such that said second shock absorbing pad is smaller than said second location such to provide an expansion joint between them.

17. An insole of claim 10 wherein the first and second anatomical centering members are spaced apart at the heel.

18. An insole of claim 17 wherein a portion of the foam material is disposed between the first and second anatomical centering members.

19. An insole of claim 10 wherein the directional air ports are substantially conical in cross section.

20. An insole of claim 10 wherein air ports disposed forward of the first shock absorbing pad direct air toward the front of the insole and air ports rearward of the first shock absorbing pad direct air toward the rear of the insole.

* * * * *